US009163524B2

(12) United States Patent
Moore et al.

(10) Patent No.: US 9,163,524 B2
(45) Date of Patent: Oct. 20, 2015

(54) VARIABLE GEOMETRY TURBINE SEAL

(75) Inventors: Simon Moore, Huddersfield (GB); James Alexander McEwen, Huddersfield (GB); Ian Higgins, Huddersfield (GB); Matthew William Edwards, Huddersfield (GB)

(73) Assignee: Cummins Ltd., Huddersfield (GB)

( * ) Notice: Subject to any disclaimer, the term of this patent is extended or adjusted under 35 U.S.C. 154(b) by 780 days.

(21) Appl. No.: 13/437,163

(22) Filed: Apr. 2, 2012

(65) Prior Publication Data

US 2012/0251298 A1 Oct. 4, 2012

(30) Foreign Application Priority Data

Apr. 4, 2011 (GB) ..... 1105726.2

(51) Int. Cl.
*F01D 17/14* (2006.01)

(52) U.S. Cl.
CPC ..... *F01D 17/143* (2013.01); *F05D 2220/40* (2013.01)

(58) Field of Classification Search
CPC ..... F01D 17/143; F01D 17/167; F01D 17/14; F01D 17/141; F01D 9/026; F01D 11/005; F05D 2220/40; F02B 37/22
See application file for complete search history.

(56) References Cited

U.S. PATENT DOCUMENTS 3,071,347 A * 1/1963 Schinnerer ..... 415/156
5,214,920 A * 6/1993 Leavesley ..... 60/602
5,267,829 A * 12/1993 Schmidt et al. ..... 415/48
5,855,117 A * 1/1999 Sumser et al. ..... 60/602
6,715,288 B1 * 4/2004 Engels et al. ..... 60/602
6,726,447 B2 * 4/2004 Lutz ..... 415/158
2007/0227603 A1 * 10/2007 Perrin et al. ..... 138/43
2010/0310365 A1 * 12/2010 Matsuyama et al. ..... 415/212.1

FOREIGN PATENT DOCUMENTS

| | | | |
|---|---|---|---|
| DE | 4232400 | C1 | 8/1993 |
| GB | 2210933 | A | 6/1989 |
| GB | 2264982 | A | 9/1993 |
| GB | 2474344 | | 4/2010 |
| JP | 5133238 | | 5/1993 |
| JP | 5-214949 | | 8/1993 |

(Continued)

OTHER PUBLICATIONS

European Search Report, Jun. 20, 2014, pp. 1-5, European Patent Office, Germany.

(Continued)

*Primary Examiner* — Nathaniel Wiehe
*Assistant Examiner* — Eldon Brockman
(74) *Attorney, Agent, or Firm* — Taft Stettinius & Hollister LLP

(57) ABSTRACT

According to an aspect of the invention, there is provided a variable geometry turbine comprising: a turbine wheel mounted for rotation about a turbine axis within a housing, the housing defining an annular inlet surrounding the turbine wheel and defined between first and second inlet sidewalls; and a cylindrical sleeve axially movable across the annular inlet to vary the size of a gas flow path through the annular inlet, the annular inlet being divided into at least two axially offset inlet portions; and a ring-like seal adjacent a free end of the sleeve, at least a part of the ring-like seal being located in-between the sleeve and the inlet portions, or a structure defining the inlet portions.

15 Claims, 9 Drawing Sheets

(56) References Cited

FOREIGN PATENT DOCUMENTS

Figure 1:
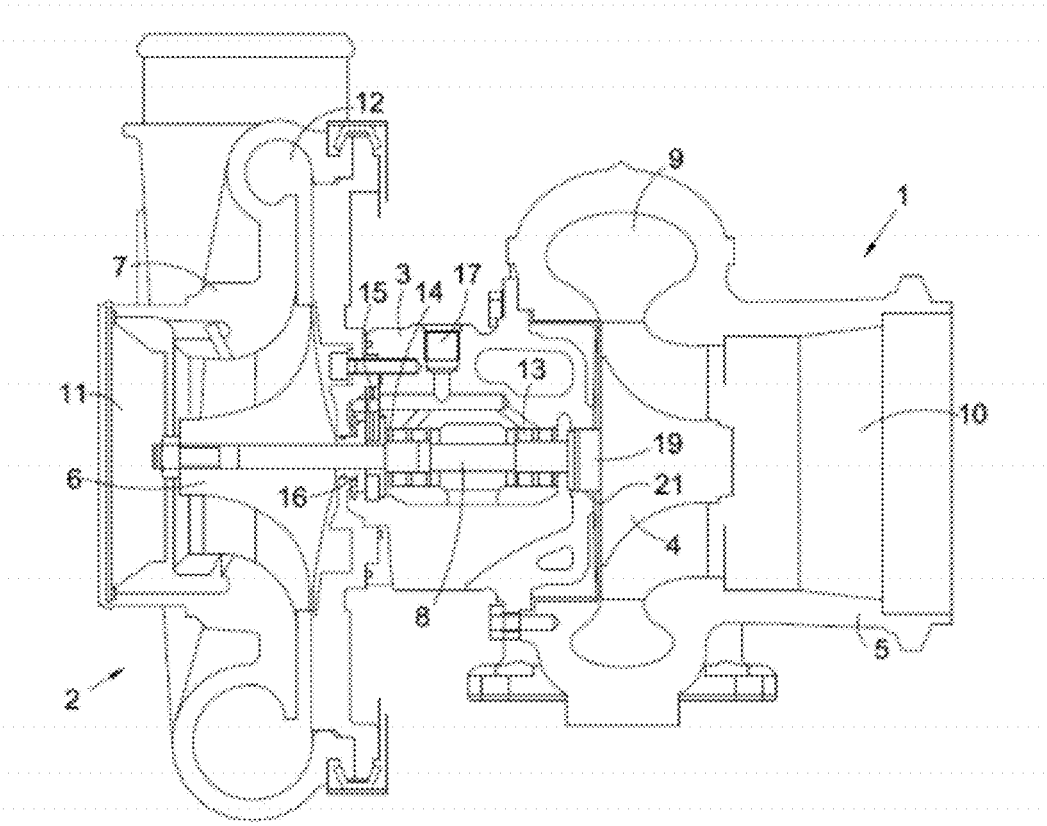

| | | |
|---|---|---|
| WO | 2005059317 A1 | 6/2005 |
| WO | WO 2011/042691 | 4/2011 |

OTHER PUBLICATIONS

U.K. Intellectual Property Office. Search Report under Section 17. Great Britain Patent Application GB1105726.2. Jul. 27, 2011.

* cited by examiner

VARIABLE GEOMETRY TURBINE SEAL

RELATED APPLICATIONS

The present application claims priority to United Kingdom Patent Application No. 1105726.2 filed Apr. 4, 2011, which is incorporated herein by reference.

The present invention relates to a turbine suitable for, but not limited to, use in a variable geometry turbocharger.

Turbochargers are well known devices for supplying air to the intake of an internal combustion engine at pressures above atmospheric pressure (boost pressures). A conventional turbocharger essentially comprises a housing in which is provided an exhaust gas driven turbine wheel mounted on a rotatable shaft connected downstream of an engine outlet manifold. A compressor impeller wheel is mounted on the opposite end of the shaft such that rotation of the turbine wheel drives rotation of the impeller wheel. In this application of a compressor, the impeller wheel delivers compressed air to the engine intake manifold. A power turbine also comprises an exhaust gas driven turbine wheel mounted on a shaft, but in this case the other end of the shaft is not connected to a compressor. For instance, in a turbocompound engine, two turbines are provided in series, both driven by the exhaust gases of the engine. One turbine drives a compressor to deliver pressurised air to the engine and the other, the "power turbine", generates additional power which is then transmitted to other components via a mechanical connection, such as a gear wheel to transmit power to the engine crankshaft, or via other types of connection, for instance a hydraulic or electrical connection.

In some applications, it may be desirable to be able to control the flow and/or or speed of flow of gas through an inlet of the turbine, which in turn affects the speed of rotation of the turbine wheel. Such control may be achieved by varying a geometry of the turbine, for example a geometry of the inlet of the turbine. One approach to varying the geometry may be to vary the orientation of vanes or other structures located in the turbine inlet, for example to change the angle of attack of gas flowing through the inlet relative to the turbine wheel. Another approach might be to control an axial width of the inlet by appropriate movement of an axially moveable wall member.

A potentially new approach to the variation of a geometry of a turbine involves providing the inlet of the turbine with a number of axially offset inlet portions defined by one or more baffles or the like located within that inlet. The opening or closing (i.e. blocking or unblocking) of one or more of these inlet portions is controlled by appropriate movement of an axially moveable sleeve, moveable along an outside diameter, or an inside diameter (depending on the particular embodiment), of the inlet portions. This new approach may be advantageous in terms of simplicity of design and implementation, and an associated reduction in costs. However, although theoretically a workable approach, a basic implementation of this approach may have performance-related problems in practice. These problems may relate, for example, to gas flowing through inlet portions that should be blocked, axial expansion of gas reducing energy available for rotation of the turbine wheel, and a non-continuous response (i.e. a step-wise response) of gas flow speed associated with movement of the sleeve.

It is an object of the present invention to obviate or mitigate one or more of the problems associated with existing turbines, whether identified herein or elsewhere, or to provide an alternative to an existing turbine.

According to an aspect of the invention, there is provided a variable geometry turbine comprising: a turbine wheel mounted for rotation about a turbine axis within a housing, the housing defining an annular inlet surrounding the turbine wheel and defined between first and second inlet sidewalls; and a ring-like seal axially movable across the annular inlet to vary the size of a gas flow path through the annular inlet, the annular inlet being divided into at least two axially offset inlet portions.

The seal may be provided adjacent a free end of, and/or attached to, a sleeve that is (also) axially moveable (e.g. across the inlet). At least a part of the ring-like seal may be located in-between the sleeve and the inlet portions, or a structure defining the inlet portions.

The seal may extend axially to an extent equal to or greater than: an axial width of one, more or all inlet portions; or an axial width of one, more or all inlet portions, plus an axial width of one, more, or all baffles that divides the inlet to form those portions.

An axial extent of the seal may be flush with an axial extent of the free end of the sleeve.

An axial extent of the seal may extend beyond an axial extent of the free end of the sleeve.

An axial extent of a free end of the seal (e.g. a free axial end, not attached to a structure for supporting or effecting movement of the seal) may vary in magnitude around a circumference of the seal to define a plurality of recesses and/or protrusions located around the circumference of the free end of the seal.

A maximum in the variation in magnitude of the axial extent may be substantially equal to: an axial width of an inlet portion; or an axial width of an inlet portion plus an axial width of a baffle that divides the inlet to define an inlet portion; or an axial width of an inlet passage through an inlet portion.

An inlet portion may comprise one or more vanes or other structures dividing the inlet portion into one or more inlet passages, and wherein the variation in magnitude of the axial extent of the seal is such that a number of protrusions and/or recesses is: greater than the number of vanes or other structures dividing the inlet portion into one or more inlet passages, and/or greater than the number of inlet passages.

The variable geometry turbine may further comprise a plurality of apertures distributed about at least a portion of a circumference of the seal (e.g. a portion of the seal that extends beyond the free end of a sleeve, if a sleeve is present).

A circumferential position of at least one aperture may be different from a circumferential position of a least one axially adjacent recess; and/or a circumferential position of each one a plurality of apertures may be different from a circumferential position of each one of a plurality of respective axially adjacent recesses.

The seal may be constructed and arranged to allow for expansion and/or compression in a radial direction, whilst still maintaining seal functionality, and wherein the seal is constructed and arranged to, at least in use, be in contact with a structure defining the inlet portions due to a resilience and/or shape of the seal.

The seal may be constructed and arranged to allow for expansion and/or compression in a radial direction, whilst still maintaining seal functionality, and wherein the seal is constructed and arranged to, in use, allow for compression in a radial direction due to a gas flow pressure acting on the seal.

The compression may be sufficient in magnitude to bring the seal into contact with a structure defining the inlet portions.

The seal may be constructed and arranged to limit the compression to a diameter that exceeds or substantially equates to a diameter of the inlet portions (e.g. by 5 mm or less, 4 mm or less, 3 mm or less, 2 mm or less, 1 mm or less, or 0.5 mm or less). A limitation may be provided in the form of a gap in a circumference of the seal that extends at least partially in the axial direction.

The seal may be provided adjacent a free end of a sleeve that is (also) axially moveable (e.g. across the inlet). Alternatively and/or additionally, the seal may be attached to the sleeve.

An inner diameter of the sleeve and/or seal may be greater than an outer diameter of the inlet portions.

The variable geometry turbine may form a part of a turbocharger, and for example (or more specifically) a variable geometry turbocharger.

Advantageous and preferred features of the invention will be apparent from the following description.

Figure 2:
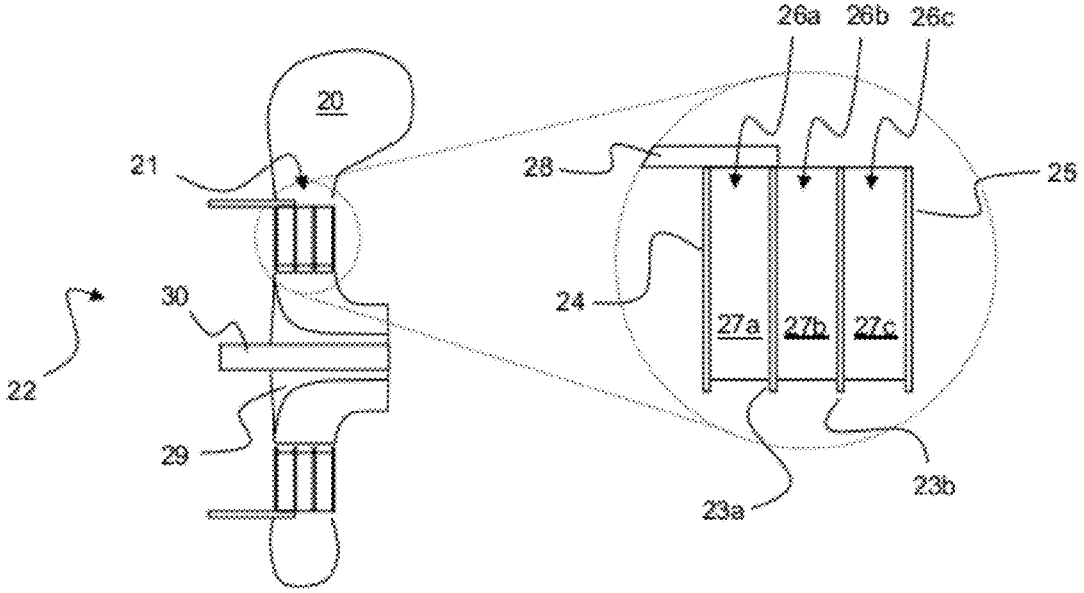
Figure 3:
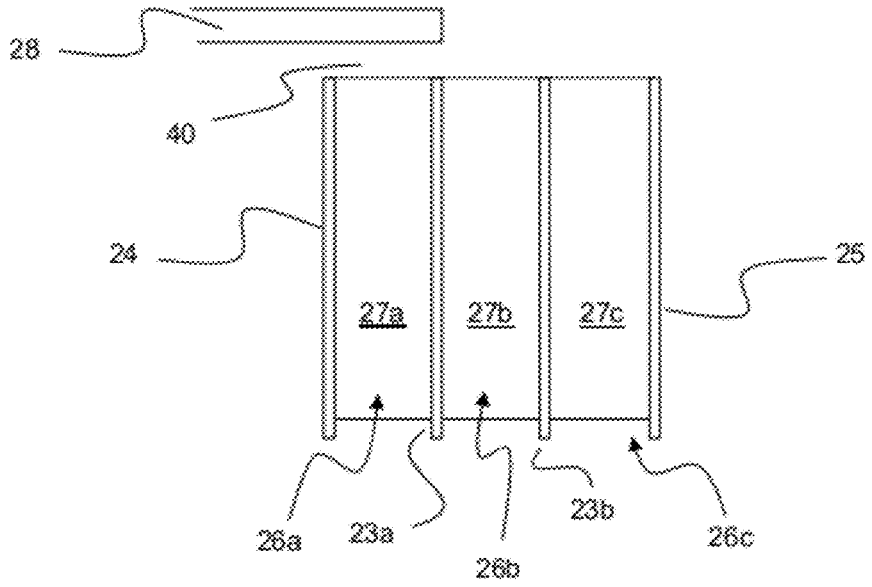
Figure 4:
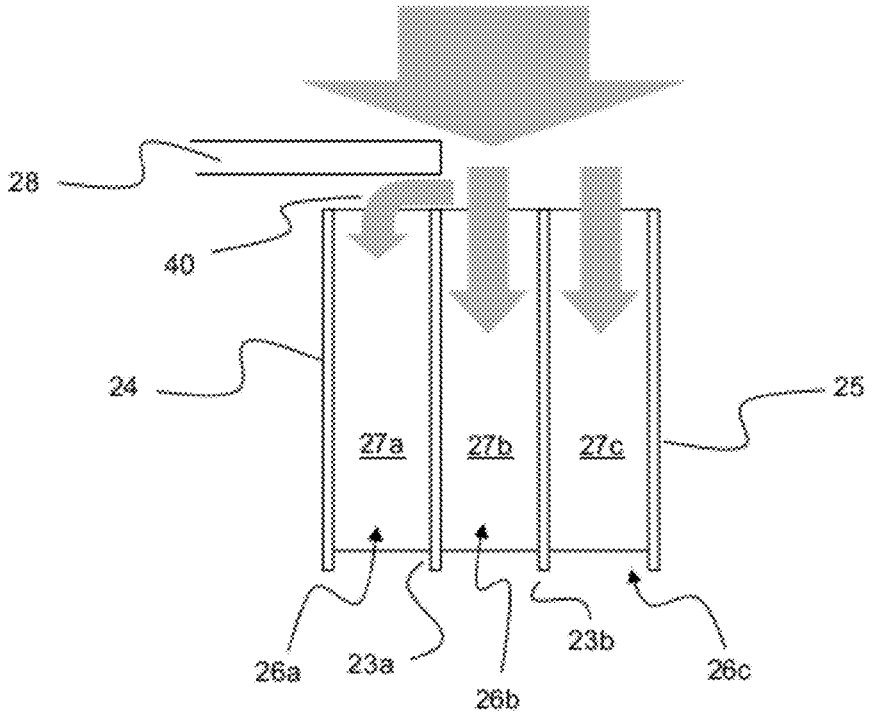
Figure 5:
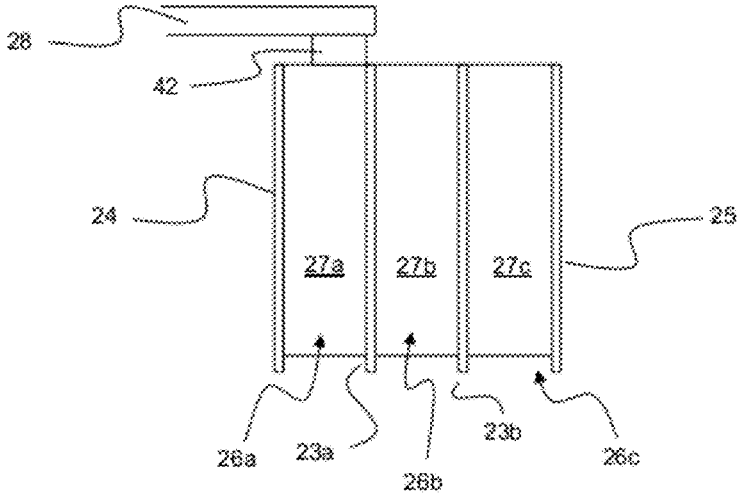
Figure 6:
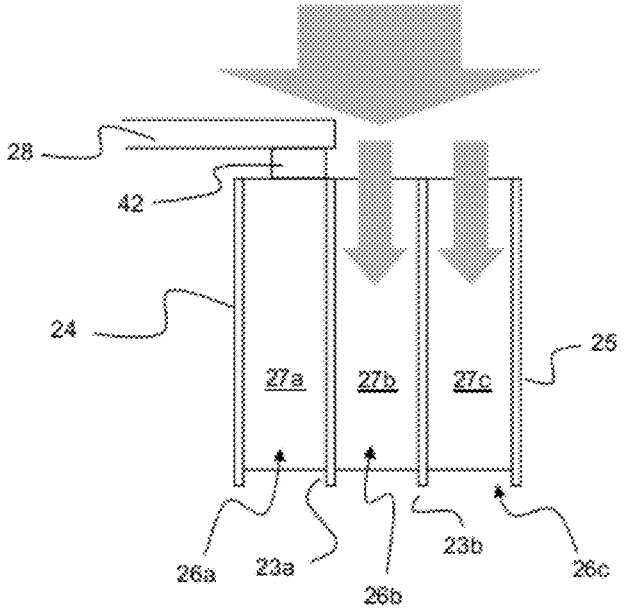
Figure 7:
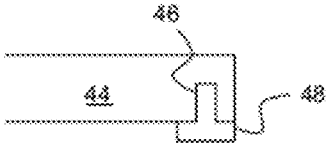
Figure 8:
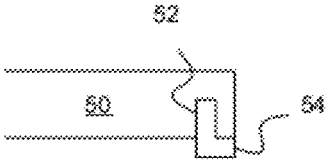
Figure 9:
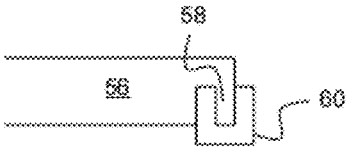
Figure 10:
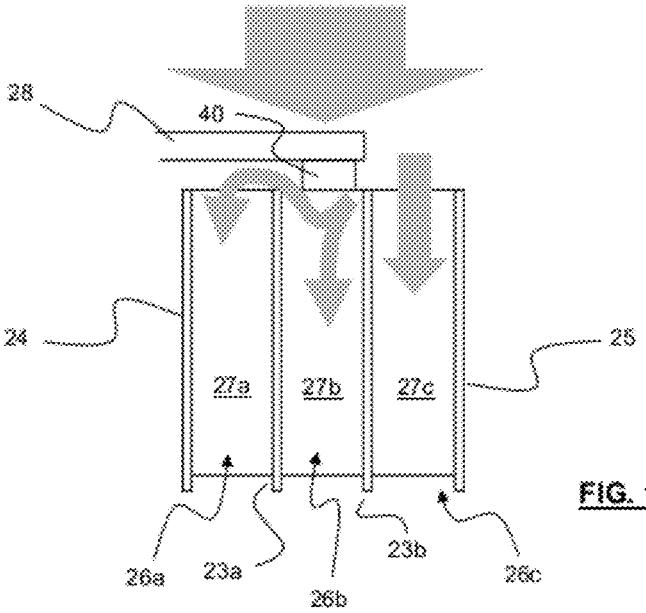
Figure 11:
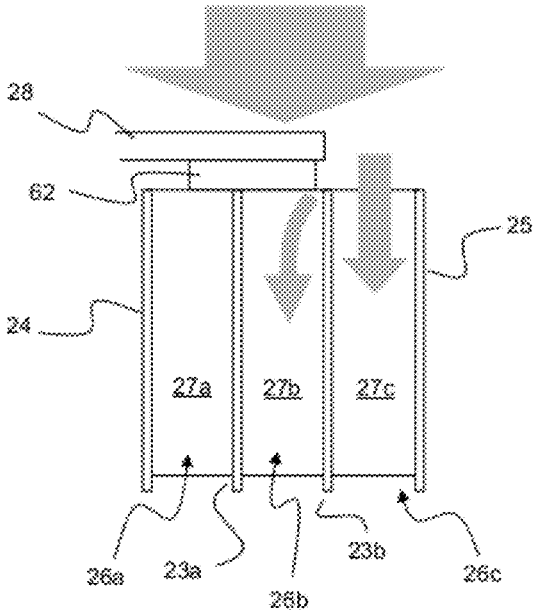
Figure 12:
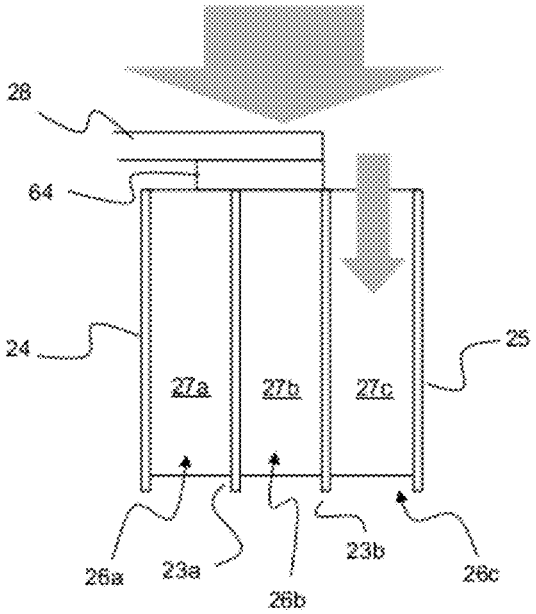
Figure 13:
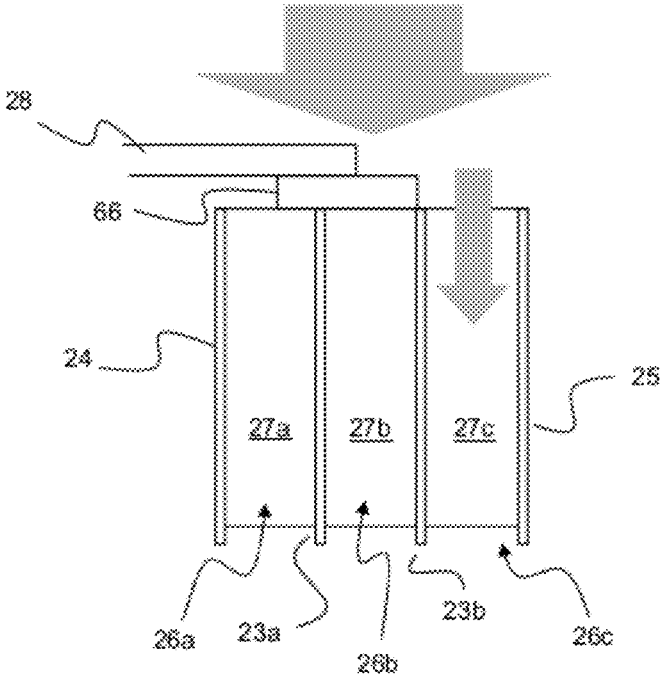
Figure 14:
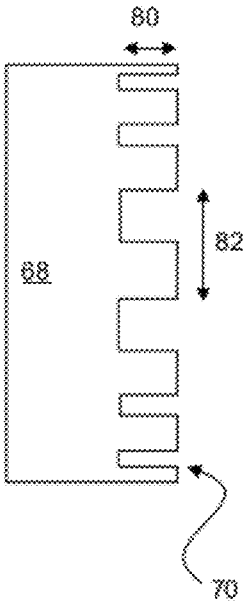
Figure 15:
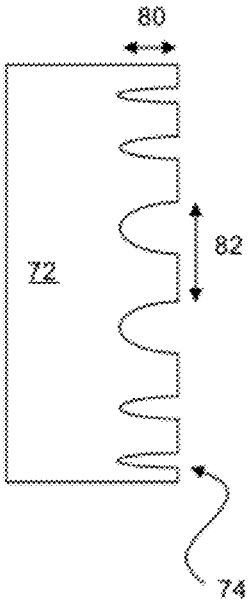
Figure 16:
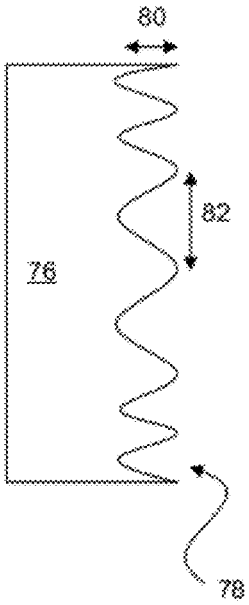
Figure 17:
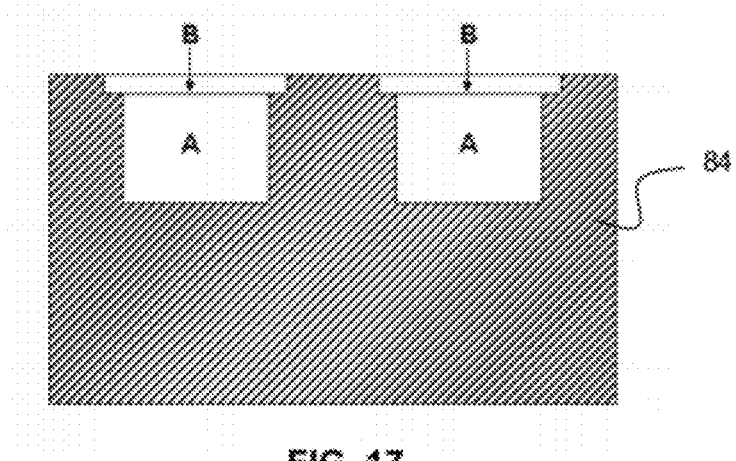
Figure 18:
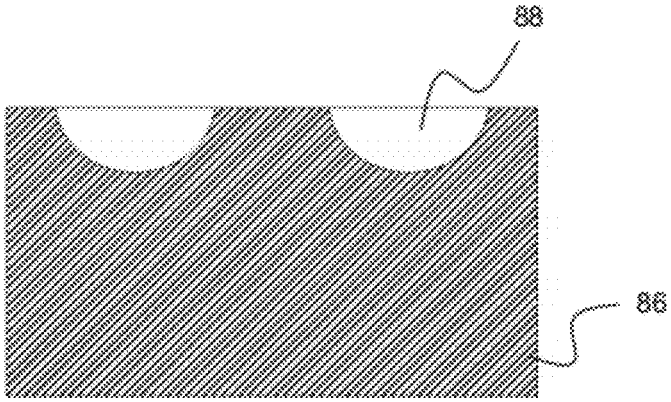
Figure 23:
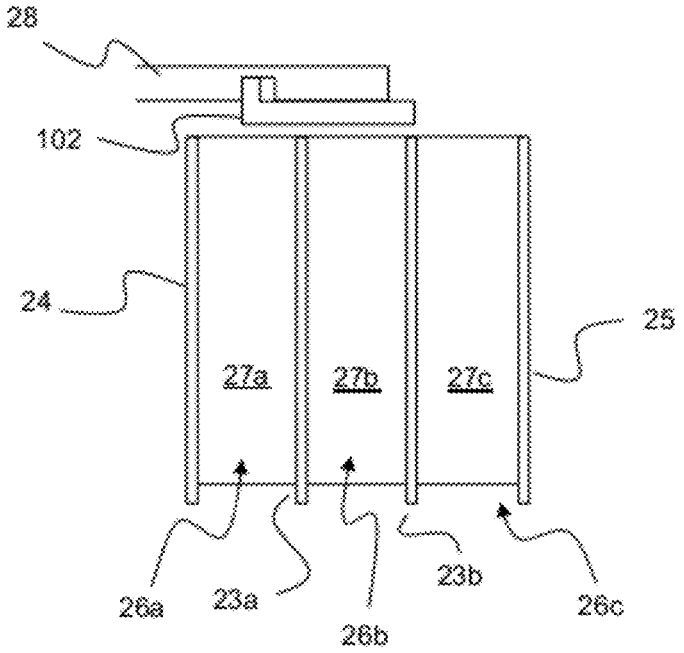
Figure 24:
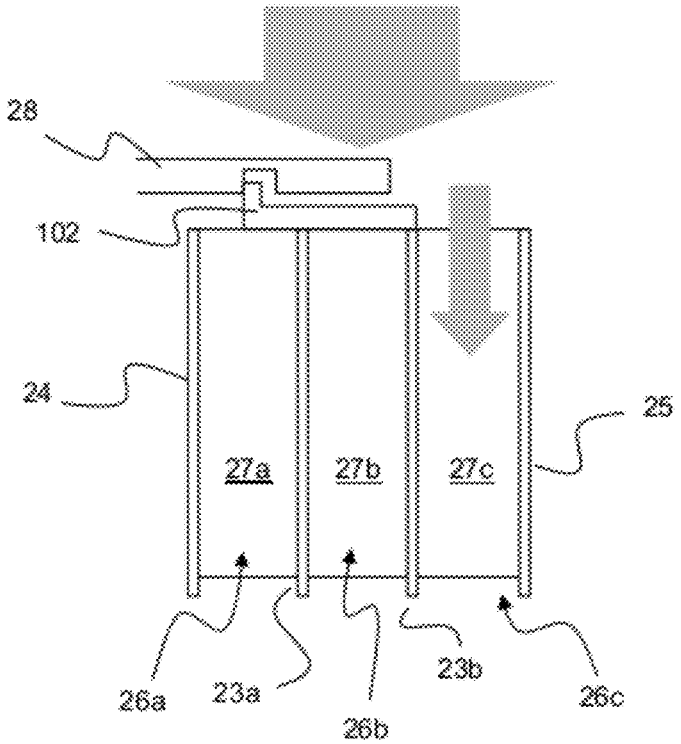
Figure 25:
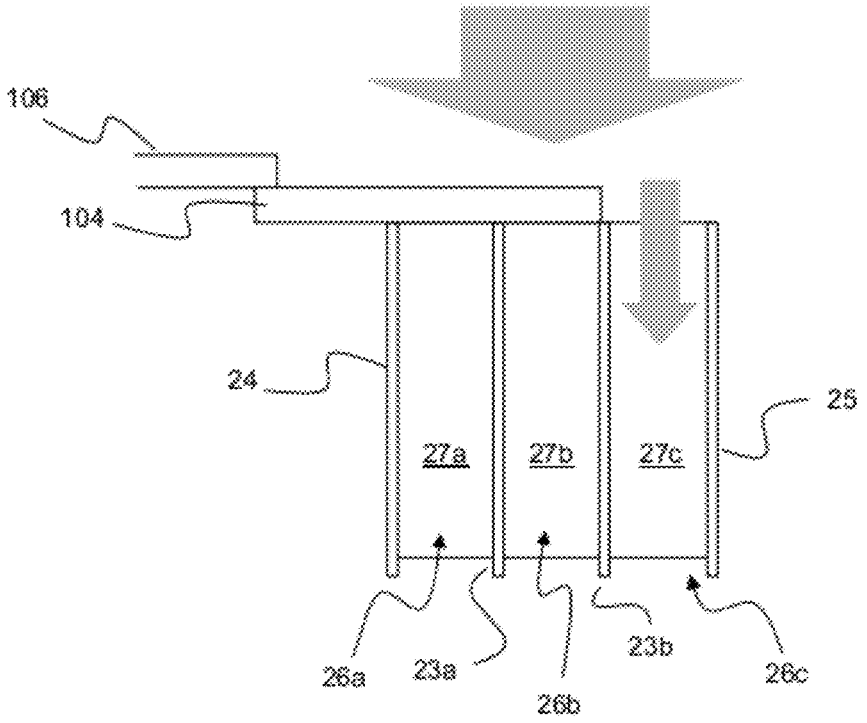
Figure 26:
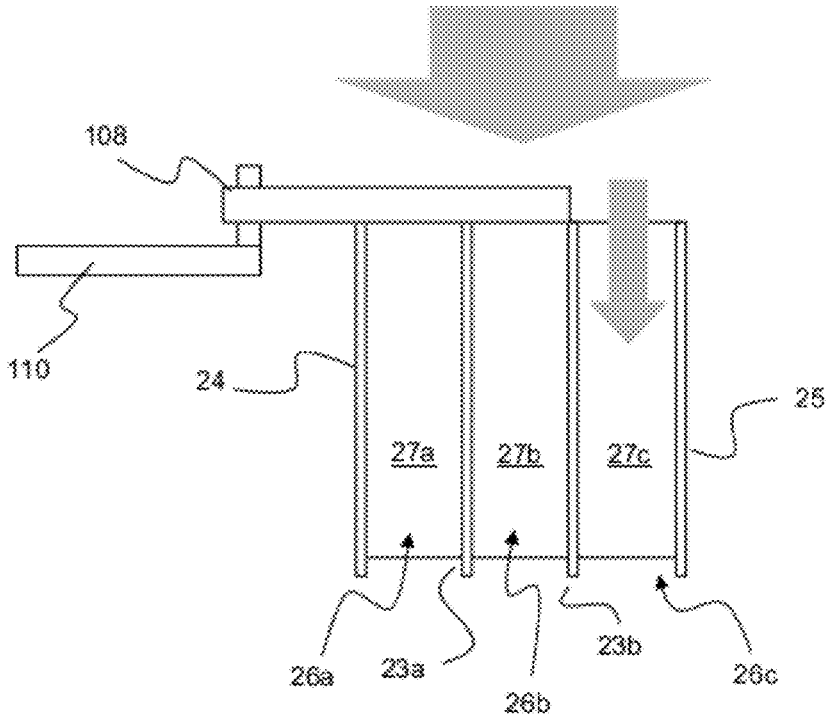

Specific embodiments of the present invention will now be described, by way of example only, with reference to the accompanying drawings, in which:

FIG. 1 schematically depicts an axial cross-section through a conventional turbocharger;

FIG. 2 schematically depicts an axial cross-section through a turbine volute and annular inlet of a turbine;

FIG. 3 schematically depicts a side-on view of the annular inlet of FIG. 2, in practice;

FIG. 4 schematically depicts the flow of gas through the annular inlet shown in FIG. 3;

FIG. 5 schematically depicts a cylindrical sleeve and seal, relative to an annular inlet of turbine, in accordance with an embodiment of the present invention;

FIG. 6 schematically depicts a flow of gas through the annular inlet shown in FIG. 5;

FIGS. 7 to 9 schematically depict different examples of seals that may be used in connection with a cylindrical sleeve;

FIG. 10 schematically depicts a potential problem that may be encountered with the sleeve and seal arrangement shown in FIG. 5;

FIG. 11 schematically depicts a sleeve provided with an axially extended seal, relative to an annular inlet, in accordance with an embodiment of the present invention;

FIG. 12 schematically depicts an axially extent of a seal being flush with an axially extent of a free end of the sleeve;

FIG. 13 schematically depicts a seal of a cylindrical sleeve and seal arrangement extending axially beyond a free end of the sleeve, in accordance with an embodiment of the present invention;

FIGS. 14 to 16 schematically depict different examples of profiling extending around a circumference of a portion of the seal that extends beyond the free end of the sleeve, in accordance with an embodiment of the present invention;

FIGS. 17 and 18 schematically depict principles associated with the profiling shown in and described with reference to FIGS. 14 to 16;

FIGS. 19 to 22 schematically depict a plurality of apertures distributed about a circumference of a portion of the seal that extends beyond the sleeve, and the relationship between the circumferential position of those apertures and recesses provided in the profiled free end of the seal;

FIG. 23 schematically depicts a cylindrical sleeve and seal arrangement, relative to an inlet of a turbine, in accordance with another embodiment of the present invention;

FIG. 24 schematically depicts the sleeve and seal arrangement of FIG. 23 in use, in accordance with an embodiment of the present invention;

FIG. 25 schematically depicts a seal arrangement, in accordance with an embodiment of the present invention; and FIG. 26 schematically depicts a variation on the seal arrangement shown in FIG. 25, in accordance with an embodiment of the present invention.

Referring to FIG. 1, the turbocharger comprises a turbine 1 joined to a compressor 2 via a central bearing housing 3. The turbine 1 comprises a turbine wheel 4 for rotation within a turbine housing 5. Similarly, the compressor 2 comprises a compressor wheel 6 which can rotate within a compressor housing 7. The turbine wheel 4 and compressor wheel 6 are mounted on opposite ends of a common turbocharger shaft 8 which extends through the central bearing housing 3.

The turbine housing 5 has an exhaust gas inlet volute 9 located annularly around the turbine wheel 4 and an axial exhaust gas outlet 10. The compressor housing 7 has an axial air intake passage 11 and a compressed air outlet volute 12 arranged annularly around the compressor wheel 6. The turbocharger shaft 8 rotates on journal bearings 13 and 14 housed towards the turbine end and compressor end respectively of the bearing housing 3. The compressor end bearing 14 further includes a thrust bearing 15 which interacts with an oil seal assembly including an oil slinger 16. Oil is supplied to the bearing housing from the oil system of the internal combustion engine via oil inlet 17 and is fed to the bearing assemblies by oil passageways 18.

In use, the turbine wheel 4 is rotated by the passage of exhaust gas from the annular exhaust gas inlet 9 to the exhaust gas outlet 10, which in turn rotates the compressor wheel 6 which thereby draws intake air through the compressor inlet 11 and delivers boost air to the intake of an internal combustion engine (not shown) via the compressor outlet volute 12.

FIG. 2 shows a modification of, or an alternative to, the turbine of FIG. 1. In FIG. 2 there is shown a turbine volute 20 and an annular inlet 21 of a turbine 22. Axially spaced across the inlet 21 are two annular baffles 23*a*, 23*b* which, together with inner and outer sidewalls 24, 25 of the inlet, define three axially offset annular inlet portions 26*a*, 26*b*, 26*c* of, in this embodiment, equal axial width. In another embodiment (not shown) the inlet portions may have different axial widths. Referring back to FIG. 2, extending axially across each of the three inlet portions 26*a*, 26*b*, 26*c* are respective annular arrays of vanes 27*a*, 27*b*, 27*c*. The vanes 27*a*, 27*b*, 27*c* are optional, and in other embodiments may be other structures, or may not be present in any or all inlet portions 26*a*, 26*b*, 26*c*. The vanes 27*a*, 27*b*, 27*c* divide each respective inlet portion 26*a*, 26*b*, 26*c* to form inlet passages in each inlet portion 26*a*, 26*b*, 26*c*. A cylindrical sleeve 28 is provided that is axially movable across the annular inlet 21 to vary the size of a gas flow path through the inlet 21 (i.e. to vary the geometry of the turbine). Movement of the cylindrical sleeve 28 may be undertaken, for example, to close or at least partially close, or open, or at least partially open, one or more of the inlet portions 26*a*, 26*b*, 26*c*.

The turbine 22 is also shown as comprising a turbine wheel 29 mounted on a turbine shaft 30 for rotation about a turbine axis. Gas passing over the turbine wheel 29 causes rotation of that wheel 29, and as a result torque is applied to the shaft 30 to drive a compressor wheel (or other structure) attached to an opposite end of the shaft (for example the compressor of FIG. 1). Rotation of the compressor wheel within a compressor housing pressurises ambient air present taken from an air inlet and delivers the pressurised air to an air outlet volute from which the air may be fed to an internal combustion engine (not shown).

The speed of the turbine wheel 29 is largely dependent upon the velocity and pressure of the gas passing through the annular inlet 21. For a fixed mass flow of gas flowing into the inlet 21, the gas velocity and pressure is a function of the inlet portions 26*a*, 26*b*, 26*c* that are open (i.e. not blocked by the sleeve 28). Thus, movement of the cylindrical sleeve 28 may be undertaken to at least partially close (i.e. block) or at least partially open (i.e. unblock) one or more of the inlet portions 26*a*, 26*b*, 26*c*, to control the velocity and pressure of the gas and, in turn, to control the speed of rotation of the turbine wheel 29.

FIG. 2 schematically depicts the cylindrical sleeve as being in contact with the baffles 23*a*, 23*b* which define the inlet portions 26*a*, 26*b*, 26*c*. However, in practice this may not be the case due to, for example, operating conditions, manufacturing tolerances, or the like. FIG. 3 schematically depicts a perhaps more realistic representation of the position of the sleeve 28 relative to the baffles 23*a*, 23*b* and associated inlet portions 26*a*, 26*b*, 26*c*. In particular, it can be seen that there is a gap 40 located between the sleeve 28 and the baffles 23*a*, 23*b*. The gap 40 is not drawn to any particular scale, and is exaggerated purely as a diagrammatic aid to understanding problems associated with the presence of such a gap 40.

In FIG. 3, the sleeve 28 has been moved to an axial position with the intention of preventing gas flow through a first inlet portion 26*a*, while at the same time allowing gas to flow through the second and third inlet portions 26*b*, 26*c*. FIG. 4 shows the flow of gas towards the sleeve 28 (in large shaded arrows in this and all other Figures), and through the inlet. It can be seen that gas does indeed flow through the second and third inlet portions 26*b*, 26*c*. However, due to the presence of the gap 40, gas also moves in an axial direction, and into and through the first inlet portion 26*a*, which should be blocked. Such unintended gas flow can have an unintended and/or unexpected consequence in terms of the resultant rotation (or change in rotation) of the of the turbine wheel located downstream of the inlet. It is therefore desirable to ensure that if an inlet portion is to be blocked, that inlet portion is blocked and stays blocked.

FIG. 5 schematically depicts much the same sleeve and turbine inlet arrangement as shown in previously described Figures. However, and in contrast with those Figures, FIG. 5 shows that, in accordance with an embodiment of the present invention, a ring-like seal 42 is provided adjacent a free end of the sleeve 28. The seal is thus also axially movable across the inlet (i.e. to vary the geometry of the inlet). In this embodiment, at least a part of the ring-like seal 42 is located in-between the sleeve 28 and the inlet portions 26*a*, 26*b*, 26*b*, or a structure defining the inlet portions 26*a*, 26*b*, 26*c*, for example the sidewalls 24, 25, and/or baffles 23*a*, 23*b*.

A ring-like seal 42 is, to the best of the applicant's knowledge, only ever used between two cylindrical surfaces which move relative to one another. The use of the ring seal 42 in the arrangement shown in FIG. 5 may not be expected to work, due to an expectation of increased wear or the like on the ring seal 42 due to the substantially non-cylindrical surface provided by the structures defining the inlet portions 26*a*, 26*b*, 26*c*. However, and perhaps surprisingly, it has been found that the ring-seal provides and maintains sealing functionality (or at least an increased functionality), at least in comparison with a sleeve in isolation with no seal. Thus, although a relatively simple solution, the solution has been found to be surprisingly effective.

FIG. 6 shows the arrangement of FIG. 5 when gas is flowing towards the sleeve 28 and inlet. The sleeve 28 has been moved with the intention of blocking gas flow through the first inlet portion 26*a*. It can been seen that, as intended, gas is prevented from flowing through the first inlet portion 26*a*, but is allowed to pass through the second and third inlet portions 26*b*, 26*c*. The presence of the seal 42 has ensured that gas cannot flow in the axial direction along or adjacent to an internal diameter or surface of the sleeve 28 and into and then through the first inlet portion 26*a*. Thus, the presence of the seal 42 at least partially obviates or mitigates the problems discussed above in relation to gas being unintentionally allowed to flow through inlet portions that should be blocked.

The seal 42 may have any appropriate form (for example any appropriate axial length), and, as will be discussed in more detail further below, may allow for a degree of radial expansion or compression to take into account thermal affects and/or gas pressure on the seal during use due to gas flow towards and through the inlet. Preferably, the seal comprises, or is formed from or with, a nickel/iron based alloy. This will allow the seal to maintain structural integrity when exposed to the high temperatures that are present in a turbine inlet of a turbocharger.

FIGS. 7 to 9 show how seals of different shapes may be used, and how these different seals may be attached to a sleeve.

FIG. 7 shows a free end of a sleeve 44 provided with a substantially radial-extending recess 46. A seal with a T-shaped cross-section 48 sits in that recess 46. A head of the 'T', which provides a substantially flat surface, sits inboard (in this embodiment) of the sleeve 44 and provides a surface which, in use, will come into contact with and ride across the structures that define inlet portions of the inlet. Such a T-shaped cross-section may be advantageous, in that the head of the 'T' can be increased or decreased in axial extent as appropriate, thus increasing or decreasing the surface that is to come into contact with the structure defining the inlet portions. The head of the 'T' seal 48 does not extend beyond a leading end of the sleeve 44 in this embodiment. In other embodiments, the head of the 'T' might extend beyond a leading end of the sleeve, which might be advantageous for reasons discussed further below.

FIG. 8 shows a leading end of another sleeve 50 provided with a substantially radially-extending recess 52. In this embodiment, the seal has an L-shaped cross-section 54. A part of the seal 54 sits in the recess 52. The seal 54 may function in substantially the same as described in relation to the T-shaped seal of FIG. 7. The L-shaped of FIG. 8 may be easier to manufacture (than the seal of FIG. 7), but may, conversely have the tendency to try and rock or tip over when being axially dragged back and forwards. A part of the 'L" seal 54 does not extend beyond a leading end of the sleeve 50 in this embodiment. In other embodiments, a part of the 'L" seal might extend beyond a leading end of the sleeve, which might be advantageous for reasons discussed further below.

FIG. 9 shows another free end of a sleeve 56 which is provided with a substantially radially-extending protrusion 58. In this embodiment, the seal is substantially U-shaped 60 in cross-section, the protrusion 58 of the free end of the sleeve 56 sitting within the 'U'. Again, the seal may function as substantially described above in relation to the seals of FIGS. 7 and 8. The U-shaped seal 60 may, however, be more difficult to manufacture relative to, for example, the seal shown in FIG. 8. A part of the 'U' seal 60 extends beyond a leading end of the sleeve, which might be advantageous for reasons discussed further below.

It will be appreciated that seals with other cross-sectional shapes may be used as and where appropriate.

The inclusion of a seal between the cylindrical sleeve and the inlet portions has been described above as being advantageous. However, depending on how the seal is constructed and arranged (which includes positioned), gas may still unintentionally flow through inlet portions that should be blocked.

FIG. 10 shows the same sleeve, seal and inlet arrangement as shown in and described with reference to FIG. 5. In contrast with FIG. 5, in FIG. 10 the sleeve 28 has been axially moved to ensure that its free end is in axial alignment with a second baffle 23*b*, with the intention of preventing gas flow through the first and second inlet portions 26*a*, 26*b*. However, FIG. 10 also shows that when gas is directed towards and through the inlet, gas not only passes through the third inlet portion 26*c*, but also passes into and through the second inlet portion 26*b* and also through the first inlet portion 26*a* via a degree of axial expansion through the second inlet portion 26*b*. The overall result is that gas flows through inlet portions 26*a*, 26*b* that should be blocked, which could affect the rotation of the turbine wheel located downstream of the inlet in a way that was not intended.

FIGS. 11 and 12 schematically depict solutions to the problems discussed in relation to FIG. 10, the solutions being applicable independently, or in combination. Indeed, any one or more embodiments described herein may, where appropriate (e.g. to the skilled person) be combined.

FIG. 11 shows the same sleeve and inlet arrangement as shown in and described with reference to FIG. 10. In contrast with FIG. 10, the seal 62 of FIG. 11 has a greater axial extent. In particular, the seal 62 extends axially to an extent equal to or greater than a width of an inlet portion 26*a*, 26*b*, 26*c*. Because the seal 62 extends in this manner, the seal 62 can never be in a location which allows gas from one inlet portion to bypass, or flow around, the seal 62 and enter into an adjacent inlet portion. An additional benefit is that the seal will always be in contact with, and thus ride or move across, at least one baffle (or other structure), which might reduce the risk of the sleeve and seal arrangement jamming or sticking on the baffle or other structure.

It will be appreciated that the exact nature (e.g. length) of the axial extent may be dependent on a particular application, or the configuration of the inlet portions and the structures that define those inlet portions. Generally speaking, this seal may extend axially to an extent equal to or greater than an axial width of one more or all inlet portions, or extend axially to an extent equal to or greater than an axial width of one, more or all inlet portions plus an axial width of one, more or all baffles (or other structures) that divides the inlet to form those portions. If the inlet portions have different axial widths, the axial extent may be equal to the smallest axial width (with or without the width of an adjacent baffle). In any event, the seal is still ring-like, as would be apparent when the seal is viewed end-on. However, with increasing axial extent (e.g. length), the seal may additionally be described as having a sleeve-like shape, or a sleeve that seals.

In one embodiment, the seal may extend axially to such an extent that the seal extends over and covers or blocks all inlet portions that are (or can ever be) covered or blocked by the sleeve. If and when appropriately sealed or blocked by such a seal, there may be no need to provide other seals upstream of the inlet, for example a seal in-between the sleeve and an actuation arrangement for that sleeve. This may reduce costs for the turbine as a whole.

FIG. 11 already shows that the axial extent of the seal is such that gas cannot flow into an unblocked inlet portion, bypass the seal, and pass into an adjacent, supposedly blocked, inlet portion. However, even though the sleeve 28 is axially aligned with a second baffle 23*b*, thereby supposedly blocking the flow of gas through the second inlet portion 26*b*, gas nevertheless still passes into and through the inlet portion 26*b*. This is because the axial extent of the free end of the sleeve 28 does not coincide with the axial extent of the seal 62 adjacent that free end of the sleeve 28. FIG. 12 schematically depicts a solution to this problem.

FIG. 12 schematically depicts much the same arrangement as shown in and described with reference to FIG. 11. However, in FIG. 12, the position of the seal 64 has either been shifted in axial position, and/or the seal has been extended in terms of its axial extent, such that an axial extent of the seal 64 adjacent the free end of the sleeve 28 is flush with that free end of the sleeve 28. This ensures that axial positioning of the sleeve 28 corresponds almost exactly to axial positioning of the seal 64. Thus, if the sleeve 28 is axially moved to block the first and second inlet portions 26*a*, 26*b*, the seal 64 will also block those inlet portions 26*a*, 26*b*, and prevent gas flowing into and through those inlet portions 26*a*, 26*b*, as demonstrated in the Figure.

Another benefit of providing a seal having an axial extent which is flush with an axial extent of a free end of the sleeve, is that axial expansion of gas is not possible in a gap that would otherwise be provided between the axial extent of the seal and the axial extent of the sleeve. Axial expansion of gas reduces the energy available for rotation of the downstream turbine wheel, and so preventing or limiting such axial expansion may improve efficiency and/or performance.

FIG. 12 showed that in order to ensure that inlet portions blocked by the sleeve were also blocked by the underlying seal, and axial extent of the seal was to be flush with an axial extent of an adjacent free end of the sleeve. An alternative solution is shown in FIG. 13. In this alternative approach, the seal 66 has an axial extent that extends beyond an axial extent of the free end of the sleeve 28. This ensures that any inlet portions 26*a*, 26*b*, 26*c* blocked by the sleeve 28 will also be blocked by the seal 66. Indeed, in this embodiment the sleeve 28 may be axially moved to align the seal 66 with appropriate baffles 23*a*, 23*b* or the like (as opposed to aligning of the sleeve itself). Another advantage with the embodiment shown in FIG. 13 is that a portion of the seal 66 extends beyond the free end of the sleeve 28, and can therefore be profiled or the like, for example to improve the controllability of the variable geometry turbine as a whole. Such profiling will be discussed in more detail below. Another advantage is that the extending seal portion assists in the controlling of actuation loads (i.e. a force on the sleeve in the axial direction, or conversely a force required to move the sleeve in the axial direction). The load is controlled by reducing the impact of the Venturi effect on the free end of the sleeve due to the reduction in radial extent of the sleeve and seal combination at the point where gas passes over it (i.e. the gas will pass over the seal, which has a smaller radial extent than the sleeve and seal combined).

Although not visible in FIG. 2, an axial extent of a leading end (which includes, or may be further defined as a leading edge or face) of the seal 66 may vary in magnitude around a circumference of the seal 66. FIGS. 14 to 16 depict different examples of such variation.

FIG. 14 shows an embodiment of a seal 68. The axial extent of a leading end 70 of the seal 68 varies in magnitude around a circumference of the seal 68. The variation has a castellated configuration. The castellation might alternatively or additionally be described as axial variation in a square-wave like manner.

FIG. 15 shows another embodiment of a seal 72. The axial extent of a leading end 74 of the seal 72 varies in magnitude around a circumference of the seal 72. The variation has a castellated-like configuration. In this embodiment, the castellation is not strictly angular, but involves a degree of curvature of side and/or base edges of the castellation. The castellation might alternatively or additionally be described as axial variation in a wave-like manner.

FIG. 16 shows another embodiment of a seal 76. The axial extent of a leading end 78 of the seal 76 varies in magnitude around a circumference of the seal 76. The variation has a wave-like property, for example varying in a sinusoidal-like manner.

Because the axial extent of a leading end of the seal varies in magnitude around a circumference of the seal, the opening or closing of the inlet portions is not undertaken in a harsh, abrupt step-wise manner, as might be the case if the axial extent exhibited no variation. An absence of axial variation might result in associated or related step-wise characteristic in the performance of the turbine as a whole. In contrast, axial variation ensures that the opening or closing of the inlet portions may be undertaken more gradually, which obviates or mitigates such a step-wise characteristic.

Referring to FIGS. 14 to 16, a maximum 80 in the variation in magnitude of the axial extent may be substantially equal to: an axial width of an inlet portion; or an axial width of an inlet portion plus an axial width of a baffle that divides the inlet; or an axial width of an inlet passage through an inlet portion. This may facilitate a smooth change or transition in gas flow through the inlet portion as the sleeve and seal is axially moved.

An inlet portion may comprise one or more vanes or other structures dividing the inlet portion into one or more inlet passages. The variation in magnitude of the axial extent in the circumferential direction (e.g. a pitch or wavelength 82) may be synchronised in some way with a location of the one or more vanes or other structures, or a spacing between the one or more vanes or other structures. The synchronisation may extend or continue around the circumference of the seal. For example, the synchronisation may be such that the variation in magnitude is in phase with the location of the vanes or other structures. Alternatively or additionally, an area defined between a maximum and minimum axial extent may be equal to an area defined between vanes or other structures in the vicinity of the variation. In other words, an area defined by recesses (or in other words between protrusions) of the leading end of the seal may be equal to an area of the opening or opening of inlet portions or inlet passages through those inlet portions. This may ensure that when a leading edge of the leading end of the seal is aligned with a baffle that divides the inlet, gas flow through an inlet portion which the seal has partially closed is optimised. The synchronisation may be used in combination with the concept described above relating to the maximum in the variation in magnitude of the axial extent.

Referring to FIG. 17, there is shown another embodiment of a seal 80 incorporating recesses A and B, only two of which are visible in the Figure. The total area of the recesses A and B has been designed to be substantially equal to the area of the throat defined by the vanes located radially inboard of the sleeve and seal (not shown in the Figure). In this way, the axial location of the seal primarily controls the flow of gas through the turbine inlet rather than the vane throat. The axial depth of each area A may, as described above, be substantially equal to the distance between adjacent baffles within the turbine inlet. The purpose of each area B is to filter out or reduce any undesirable effects that the baffle has on the desired flow or pressure characteristic when that flow is passing the free end of the sleeve over the baffle. This is achieved by allowing more circumferential area to be exposed to the gas flow at the point at which area A starts to be concealed by a baffle. For this reason the axial depth of area B is equal to the axial thickness of a baffle.

Alignment of a single vane throat area with a radially overlying recess of the seal may only be important if the number of recesses is effectively equal to the number of vanes. It will be appreciated that this does not necessarily need to be the case in all embodiments. In alternative embodiments, more recesses may be desired for example. In this case, the same basic theory can be applied as discussed above, i.e. the total flow area defined by the recesses may be substantially similar or equal to the total flow area defined by the combination of all of the vane throats. The shape of the profile of the end of the seal defined by one or more recesses and/or protrusions can be tailored to meet a specific requirement. For example, in addition or in the alternative to the profiles shown in FIGS. 14 to 16, the seal may be provided with a saw tooth, sinusoidal or semicircular profile.

Referring to FIG. 18, a seal 86 with semicircular recesses 88 may be particularly desirable because semicircular recesses offer a good compromise between flow characteristic and design for manufacture. A semicircle profile can be machined relatively easily in comparison to some more complex profiles, but still offers a circumferential increase in flow area with respect to axial position, to filter out an effect of a baffle.

As discussed above, it may be advantageous in certain embodiments for the axial depth of recesses of a seal to be substantially equal to the spacing between adjacent baffles within the turbine inlet (possibly including the width of one baffle). In such embodiments, it may also be advantageous that at least one or more, more preferably most, or all, of the baffles should have substantially equal axial spacing within the inlet (i.e. so that the inlet portions have equal axial widths).

In some embodiments the recesses at the end of the seal need not all be the same shape, size or have equal spacing. However, it is generally preferred that their combined cross-sectional area relative to gas flow through the turbine inlet should be substantially equal to the cross-sectional area of the throat area of at least one annular array of inlet gas passages defined by the vanes in a given inlet portion.

The concept of variation in an axial extent of a seal may be alternatively or additionally described or defined in many other ways, as will now be discussed.

An axial extent of a leading end of the seal varies in magnitude around a circumference of the seal. This results in a plurality of recesses and/or protrusions being defined around the circumference of the leading end of the seal. The recesses (which may, in any embodiment, be defined as spaces between protrusions, or cut-outs, or cut-aways) extend through the entire thickness or the sleeve. The recesses and/or protrusions are present to, upon movement of the sleeve, selectively block or expose (e.g. close or open) at least a part of inlet portions, or inlet passages provided in those portions by other structures.

In a known prior art sleeve, a leading portion (i.e. not a leading end, but next to the leading end) of the sleeve extends further in an axial direction than another, adjacent portion (e.g. an outer diameter portion) to accommodate a vane structure upon appropriate movement of the sleeve. However, an axial extent of a leading end of the prior art sleeve does not vary in magnitude around a circumference of the sleeve. Instead, the axial extent defines a circular structure. In this prior art sleeve, a plurality of recesses and/or protrusions are not defined around the circumference of the leading end of the sleeve.

As discussed above, a variation in magnitude of the axial extent in the circumferential direction (e.g. a pitch or wavelength) may be synchronised in some way with a location of one or more vanes or other structures that divide an inlet portion into a number of inlet passages. In theory, such synchronisation, which corresponds to appropriate alignment of the recesses of the seal with the structures dividing the inlet portions, may be readily achievable. However, in practice, this may not be the case. In some instances, it may be difficult to ensure that the required alignment is undertaken during manufacture or installation of the sleeve, seal and inlet arrangement, or to maintain such alignment during use of the arrangement. If the alignment (i.e. synchronisation) is not achieved and maintained, modelling has shown that the efficiency of the arrangement as a whole is vastly reduced. For instance, only a small misalignment can have a great and adverse affect on the flow of gas through the inlet. In summary, it has been found that the efficiency is extremely sensitive to even slight misalignment. It is therefore desirable to obviate or mitigate this sensitivity—i.e. it is desirable to desensitise the arrangement to misalignment of the recesses (or other profiling) of the seal relative to structures defining passages through inlet portions, or the passages themselves.

Two solutions to the above-mentioned problems are proposed. One solution is to desensitise the arrangement to misalignment by increasing the number of recesses provided in the leading end of the seal, such that the number of recesses (and/or protrusions) is greater than the number of vanes or other structures dividing the inlet portion into one or more inlet passages, and/or greater than the number of inlet passages defined by those structures. The total area defined by the total number of recesses might, as described above, be equal to the total throat area defined by the vanes or other structures. Alternatively, the area might be different. By increasing the number of recesses (and/or protrusions) the effects of misalignment are greatly reduced, while the benefits of providing the recesses are maintained.

Another solution to the above-mentioned problem, which may be used independently of, or in conjunction with, the increase in the number of recesses, is the provision of a plurality of apertures distributed about a circumference of a portion of the seal that extends beyond the free end of a sleeve. The apertures are not recesses in the end of the seal, but are instead holes passing through the seal, at a distance from the end of the seal. It has been found that the presence of these apertures results in a desensitisation of the alignment of the recesses relative to the inlet passages defined in the inlet portions by vanes or other structures. This desensitisation may be further improved by ensuring that a circumferential position of at least one of those apertures is different from a circumferential position of at least one axially adjacent recess (i.e. a recess that is adjacent to the aperture in the axial direction). More generally, a circumferential position of each one of a plurality of apertures may be different from a circumferential position of each one of a plurality of respective axially adjacent recesses, further improving the desensitisation.

FIGS. 19 to 22 schematically depict exemplary seals embodying the two solutions discussed above.

Figure 19:
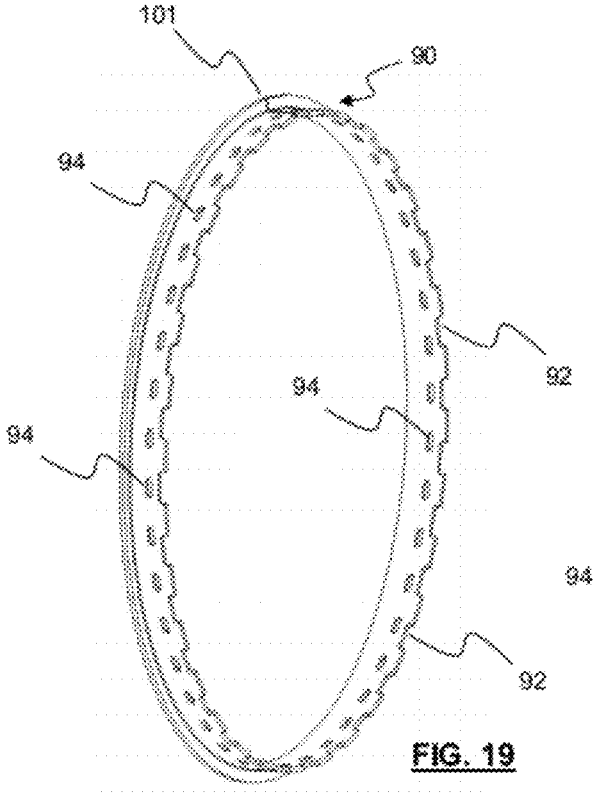

FIG. 19 schematically depicts a seal 90. An axial extent of a leading end of the seal 90 varies in a castellated manner, thus defining a plurality of substantially rectangular-shaped recesses 92 about a circumference of the seal 90. Although not shown in the Figure, the number of recesses 92 (and/or protrusions either side of those recesses 92) is greater in number than the number of vanes or other structures dividing an inlet portion of an inlet into a number of inlet passages.

Figure 20:
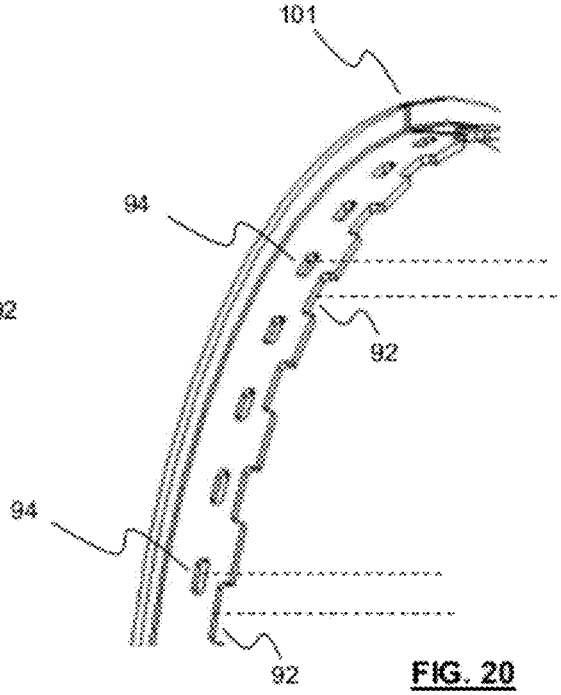

FIG. 19 also shows that a plurality of apertures 94 is provided in the seal 90. The apertures 94 have a slot-like shape, but other aperture shapes are possible and may be tailored (via trial and error or modelling or the like) to appropriately affect the sensitivity of the alignment of the recesses 92 of the seal 90 relative to the vanes or other structures defining inlet passages in the inlet portions of the inlet of the turbine. FIG. 20 shows that a circumferential position (indicated by dotted lines) of the apertures 94 is, or at least in general is, different from a circumferential position of at least one axially adjacent recess 92.

Figure 21:
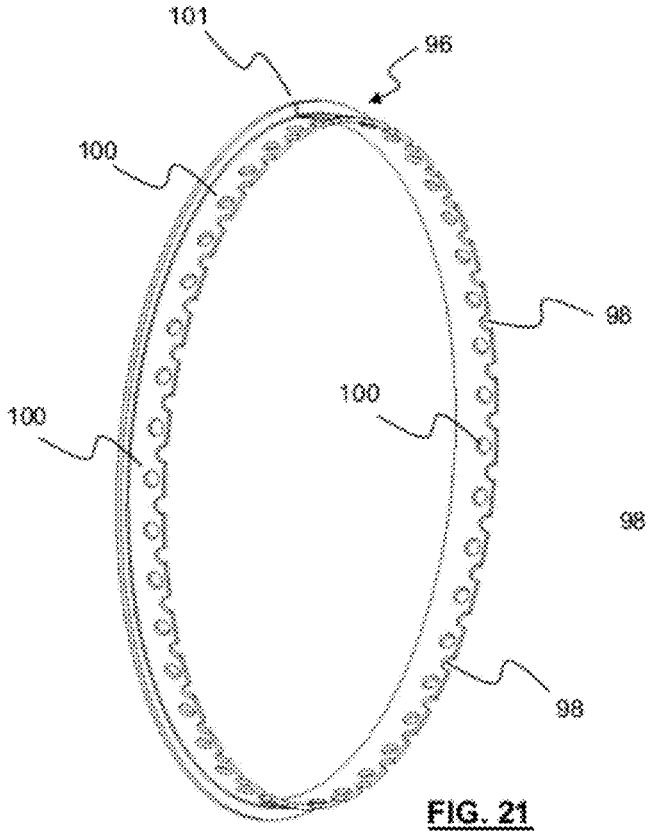

FIG. 21 schematically depicts another seal 96. An axial extent of a leading end of the seal 90 varies in a castellated-like manner, defining a plurality of substantially semicircular-shaped recesses 98 about a circumference of the seal 96. Although not shown in the Figure, the number of recesses 98 (and/or protrusions either side of those recesses 98) is greater in number than the number of vanes or other structures dividing an inlet portion of an inlet into a number of inlet passages.

Figure 22:
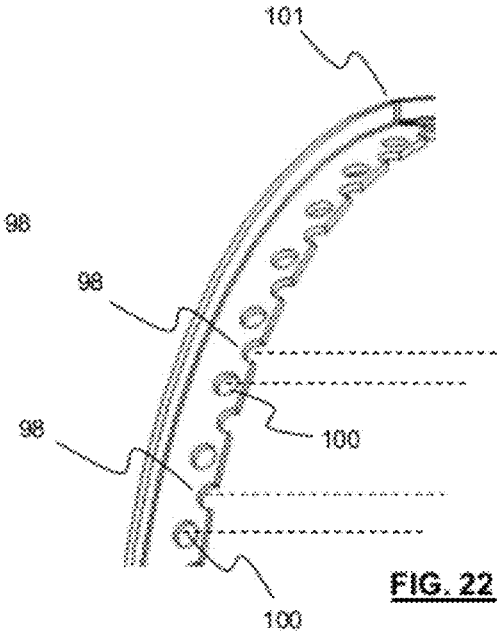

FIG. 21 also shows that a plurality of apertures 100 is provided. The apertures 94 have a circular shape, but other aperture shapes are possible and may be tailored (via trial and error or modelling or the like) to appropriately affect the sensitivity of the alignment of the recesses of the seal 96 relative to the vanes or other structures defining inlet passages in the inlet portions of the inlet of the turbine. FIG. 22 shows that a circumferential position (indicated by dotted lines) of the apertures 100 is, or at least in general is, different from a circumferential position of at least one axially adjacent recess 98.

In general, in order for the seals discussed above to provide an optimum sealing functionality, the seal should, at least in use, come into contact with (or at least be in close proximity with) the baffles or other structures dividing the inlet into one or more inlet portions. This allows for appropriate sealing off of inlet portions through which gas should not flow. One way of achieving this would be to ensure that the seal is biased into contact with those structures. The biasing may be achieved by an appropriate construction and/or arrangement of the seal itself, such that the seal is partly sprung or otherwise biased to urge itself against the structure or structures defining the inlet portions. This may generally be described as the seal being constructed and arranged to have a particular resilience and/or shape to achieve this affect. The term "resilient" is used to include the situation where the seal expands or contracts in a radial direction due to, for example, gas flow pressure, or thermal effects, but can return to its original shape. This assures that the seal has a prolonged life, and does not function on only one, or a limited number of, occasions.

In another embodiment, the seal may be constructed and arranged to be in contact (or urged into contact) with the structures defining inlet portions when the turbine is in use, and in particular when gas is flowing towards the seal, and exerting a gas pressure on that seal. The seal may be constructed and arranged so that when gas pressure is acting on this seal, the seal is compressed in a radially direction to come into contact with the structures defining the inlet portions, thus providing the appropriate seal. This may be achieved by the seal having one or more overlapping circumferential portions, or a circumferential gap that extends axially along the seal (e.g. see FIGS. 19 to 22, where such a gap 101 is depicted), or the like, which allows for a required degree of compression for an appropriately applied gas pressure. FIG. 23 show such a seal 102 when there is no, or insufficient gas pressure to urge the seal 102 against the baffles 23*a*, 23*b* of the inlet. In contrast, FIG. 24 shows the situation when there is gas pressure, or sufficient gas pressure, acting on the seal 102 to cause the seal to compress partially in the radial direction, and thus to come in contact with the baffles 23*a*, 23*b*, sealing off first and second inlet portions 26*a*, 26*b* as intended.

The seal 102 can be configured and arranged in one of a number of ways to achieve the desired functionality. For example, the seal can be constructed and arranged to have a particular degree of radial compression for a particular applied gas pressure or range of gas pressures. However, care should be taken to ensure that the seal 102 is not urged against the baffles 23*a*, 23*b* to such an extent that movement of the sleeve 28 and the attached seal 102 becomes either impossible, or impossible to achieve without excessive wear being caused to one or both of the seal 102 and baffles 23*a*, 23*b*. To overcome this problem, the seal 102 may be alternatively or additionally constructed and arranged to limit the degree or extent of compression to a diameter that substantially equates to, or exceeds, a diameter of the inlet portions 26*a*, 26*b*, 26*c* (which equates to the outer diameter of the baffles 23*a*, 23*b* defining those inlet portions 26*a*, 26*b*, 26*c*). It will be appreciated that the limitation should not be such that there is an excessive gap left in-between the limit of the compression of the seal 102 and the outer diameter of the baffles 23*a*, 23*b*, or otherwise the seal 102 will provide an unsatisfactory sealing functionality. The limitation may be decided upon by balancing the amount of wear that is likely to be incurred by the seal 102 during use against the reduction in sealing performance that would be experienced by providing an ever increasing gap between the limitation of the seal's 102 compression and the baffles 23*a*, 23*b*.

In one embodiment, the limitation can be realised by providing a gap in the circumference of the seal that extends in the axial direction, as already described above (e.g. see FIGS. 19 to 22, where such a gap 101 is depicted). The seal will still be ring-like, but will not define a complete continuous ring. In use, the pressure on the seal may be such as to compress the seal, causing the gap to close. When the gap closes, the compression is limited accordingly, thus providing a limited compression diameter.

Thus far, a seal has been described as being located between a sleeve and one or more structures that define the inlet portions, at least when the seal is moved across the inlet. Other arrangements are possible, in which a seal is employed. In such arrangements, a sleeve might not be required. FIGS. 25 and 26 depict alternative embodiments to those already described, which may be described as a modification or development of the arrangement and concepts discussed above in relation to FIG. 13.

In FIG. 25, a seal 104 has an axial extent that extends beyond an axial extent of a free end of a sleeve 106 to which the seal 104 is attached. In contrast to FIG. 13, however, the seal 104 now extends far beyond the sleeve 106, to the extent that the geometry of the inlet is solely dictated by the position of the seal 104, since the sleeve 106 will not and cannot enter the inlet.

FIG. 26 shows that a sleeve is not required to carry the seal. In FIG. 26, a seal 108 has an axial extent that extends beyond an axial extent of alternative component 110 (e.g. comprising one or more rods) that carries the seal 108. Again, in contrast to FIG. 13, the seal 104 now extends far beyond the component 110 that carries the seal 108, to the extent that the geometry of the inlet is solely dictated by the position of the seal 108, since the component 110 will not and cannot enter the inlet.

Although the arrangements of FIGS. 25 and 26 are different to that shown in FIG. 13, they still share many, if not all, of its benefits, and/or can be modified in the same way as discussed above (e.g. variation in axial extent of leading end, provision of apertures, and so on).

Even though the seals in FIGS. 25 and 26 have an increased axial extent in comparison with the seals of other embodiments described herein, the seal is still ring-like, as would be apparent when the seal is viewed end-on. However, with increasing axial extent (e.g. length), the seal may additionally be described as having a sleeve-like shape, or a sleeve that seals. A sleeve that seals may be distinguished from a generic sleeve known in the art by virtue of its sealing functionality, which may be defined or described (or further defined, or further described) by reference to one of more of the seal features described above (e.g. the ability to expand or compress under pressure, or the provision of a gap that allows for compression to a limited extent).

In one or more embodiments, one, more or all inlet portions may comprise one or more vanes or other structures, having the same or different configurations, dividing the inlet portion into one or more inlet passages. One or more inlet portions may be free of vanes or other structures that would otherwise divide the inlet portion.

The sleeve and or seal may be free of vanes. It is known in the prior art to provide a sleeve (which has no seal that is moveable with the sleeve) with vanes, for example to affect the angle of attack of gas flowing past the vanes. However, it is important to note that such a sleeve is cylindrical, and this cylinder is then provided with vanes. In other words, an axial extent of a leading end of the prior art sleeve does not vary in magnitude around a circumference of the sleeve. In this prior art sleeve, a plurality of recesses and/or protrusions are not defined around the circumference of the leading end of the sleeve. Instead, vanes protrude from a circular face of that sleeve. Thus, the features of the known sleeve are not the same as the axial variation in the leading end of the seal as described herein.

Preferentially, the sleeve (if used) and/or seal surrounds the inlet portions, which has been found to give an improved aerodynamic performance. In other words, the inner diameter of the sleeve (if used) and/or seal is greater, or substantially equates to, than an outer diameter (or outer radial extent) of the inlet portion or portions. In another embodiment, the sleeve (if used) and/or seal may be surrounded by the inlet portions. In other words, the outer diameter of the sleeve (if used) and/or seal may be less than, or substantially equates to, an inner diameter of the inlet portion or portions. In another embodiment, the sleeve (if used) and/or seal may be moveable through the inlet portion or portions. In other words, the diameter (e.g. inner or outer, or average diameter) of the sleeve (if used) and/or seal may be less than an outer diameter of the inlet portion or portions, and greater than an inner diameter of the inlet portion or portions.

The extent of the sleeve and/or seal in the radial direction (which may be described as a thickness of the sleeve or seal) may be small, to reduce aerodynamic load on the sleeve and/or seal, or actuators for moving the sleeve (to which the seal is attached). 'Small', may be defined as being less than an axial width of the annular inlet, or less than an axial width of an inlet portion or passageway. For example, the sleeve and/or seal may be less than 5 mm thick, less than 4 mm thick, less than 3 mm thick, less than 2 mm thick, or less than 1 mm thick, for example approximately 0.5 mm thick or less.

Typically, exhaust gas flows to the annular inlet from a surrounding volute or chamber. The annular inlet is therefore defined downstream of the volute, with the downstream end of the volute terminating at the upstream end of the annular inlet. As such, the volute transmits the gas to the annular inlet, while the gas inlet passages or portions of the present invention receive gas from the volute. In some embodiments, the first and second inlet sidewalls which define the annular inlet are continuations of walls which define the volute. The annular inlet may be divided into at least two axially offset inlet passages or portions by one or more baffles located in the annular inlet, and which are therefore positioned downstream of the volute.

The turbine of the present invention has been illustrated in the Figures using a single flow volute, however it is applicable to housings that are split axially, whereby gas from one or more of the cylinders of an engine is directed to one of the divided volutes, and gas from one or more of the other cylinders is directed to a different volute. It is also possible to split a turbine housing circumferentially to provide multiple circumferentially divided volutes, or even to split the turbine housing both circumferentially and axially. It should be appreciated, however, that an axially or circumferentially divided volute is distinguished from the multiple gas inlet passages or portions present in the turbine of the present invention. For example, the gas inlet passages or portions relate to a nozzle structure arranged to accelerate exhaust gas received from the volute towards the turbine, and optionally to adjust or control the swirl angle of the gas as it accelerates. The multiple gas inlet passages or portions forming part of the present invention may be further distinguished from a divided volute arrangement in that, while the gas inlet passages or portions receive gas from the volute (or divided volute), and split the gas into an array of paths directed on to the turbine, a divided volute receives gas from the exhaust manifold so as to retain the gas velocity in gas pulses resulting from individual engine cylinder opening events.

It will be appreciated that axially offset inlet passages or portions include inlet passages or portions with different axial positions and/or inlet passages with different axial extents. Axially offset inlet passages or portions may be spaced apart, adjacent or axially overlapping.

The term 'free end' has been used herein to describe, for example, an end of the sleeve. The 'free end' will, as shown in the Figures, be the functional end of the sleeve—i.e. the end of the sleeve that is moveable within and/or across the inlet. The sleeve and/or seal are moveable across the inlet, and across and/or over at least one, more or all of the structures (e.g. baffles) that divide the inlet into portions, thus allowing one, more or all of those inlet portions to be selectively blocked or unblocked.

Terms such as 'radial' and 'axial' have been used herein, for example to describe movement of a sleeve, or the orientation of a structure. 'Axial' generally refers to the direction along which the turbine shaft (i.e. the shaft attached to the turbine wheel) extends, or a direction parallel to that shaft. 'Radial' is a direction substantially perpendicular to the direction along which the turbine shaft (i.e. the shaft attached to the turbine wheel) extends, or a direction parallel to that perpendicular direction.

Embodiments have thus far been described in relation to a turbine of a variable geometry turbocharger. A variable geometry turbocharger may be a particularly suitable application for the embodiments of the turbine, since a variable geometry turbocharger requires reliable operation, and needs to provide and maintain operational efficiency in order to meet end user requirements. The described embodiments assist in achieving this. However, the turbine might be used in other fields, for example in any field where a variable geometry turbine is required, and in particular in fields where the problems discussed above exist.

From a reading of this disclosure, it may be apparent to the skilled person that various modifications may be made to one or more embodiments disclosed herein, without departing from the scope of the claims that follow.

The invention claimed is:

1. A variable geometry turbine comprising:

a turbine wheel mounted for rotation about a turbine axis within a housing, the housing defining an annular inlet surrounding the turbine wheel and defined between first and second inlet sidewalls; and a ring-like seal axially movable across the annular inlet to vary the size of a gas flow path through the annular inlet, the annular inlet being divided into at least two axially offset inlet portions, wherein an axial extent of a free end of the seal varies in magnitude around a circumference of the seal to define a plurality of recesses and/or protrusions located around the circumference of the free end of the seal.

2. The variable geometry turbine of claim 1, further comprising an axially moveable cylindrical sleeve, the ring-like seal being attached to the sleeve, and/or provided adjacent to a free end of the sleeve, at least a part of the ring-like seal being located in-between the sleeve and the inlet portions, or a structure defining the inlet portions, when the seal is moved across the inlet.

3. The variable geometry turbine of claim 1, wherein the seal extends axially to an extent equal to or greater than:

an axial width of one, more or all inlet portions; or an axial width of one, more or all inlet portions, plus an axial width of one, more, or all of a baffle or of a plurality of baffles that divide the inlet to form those portions.

4. The variable geometry turbine of claim 2, wherein an axial extent of the seal is flush with an axial extent of the free end of the sleeve.

5. The variable geometry turbine of claim 2, wherein an axial extent of the seal extends beyond an axial extent of the free end of the sleeve.

6. The variable geometry turbine of claim 1, wherein a maximum in the variation in magnitude of the axial extent is substantially equal to:

an axial width of an inlet portion; or an axial width of an inlet portion plus an axial width of a baffle that divides the inlet to define an inlet portion; or an axial width of an inlet passage through an inlet portion.

7. The variable geometry turbine of claim 1, wherein an inlet portion comprises one or more vanes or other structures dividing the inlet portion into one or more inlet passages, and wherein the variation in magnitude of the axial extent of the seal is such that a number of protrusions and/or recesses is:

greater than the number of vanes or other structures dividing the inlet portion into one or more inlet passages, and/or greater than the number of inlet passages.

8. The variable geometry turbine of claim 1, further comprising a plurality of apertures distributed about at least a portion of a circumference of the seal.

9. The variable geometry turbine of claim 1, wherein the seal is constructed and arranged to allow for expansion and/or compression in a radial direction, whilst still maintaining seal functionality, and wherein the seal is constructed and arranged to, at least in use:

be in contact with a structure defining the inlet portions due to a resilience and/or shape of the seal; and/or allow for compression in a radial direction due to a gas flow pressure acting on the seal.

10. The variable geometry turbine of claim 9, wherein the compression is sufficient in magnitude to bring the seal into contact with a structure defining the inlet portions.

11. The variable geometry turbine of claim 9, wherein an inner diameter of the seal is greater than an outer diameter of the inlet portions, and wherein the seal is constructed and arranged to limit the compression to a diameter that substantially equates to, or exceeds, a diameter of the inlet portions.

12. The variable geometry turbine of claim 1, wherein the variable geometry turbine forms part of a turbocharger.

13. The variable geometry turbine of claim 11, wherein the limit is provided in the form of a gap in a circumference of the seal that extends at least partially in the axial direction.

14. A variable geometry turbine comprising:

a turbine wheel mounted for rotation about a turbine axis within a housing, the housing defining an annular inlet surrounding the turbine wheel and defined between first and second inlet sidewalls;

a ring-like seal axially movable across the annular inlet to vary the size of a gas flow path through the annular inlet, the annular inlet being divided into at least two axially offset inlet portions; and a plurality of apertures distributed about at least a portion of a circumference of the seal, wherein:

an axial extent of a free end of the seal varies in magnitude around a circumference of the seal to define a plurality of recesses located around the circumference of the free end of the seal, and wherein a circumferential position of at least one aperture is different from a circumferential position of at least one axially adjacent recess; and/or a circumferential position of each one a plurality of apertures is different from a circumferential position of each one of a plurality of respective axially adjacent recesses.

15. A variable geometry turbine comprising:

a turbine wheel mounted for rotation about a turbine axis within a housing, the housing defining an annular inlet surrounding the turbine wheel and defined between first and second inlet sidewalls; and a ring-like seal axially movable across the annular inlet to vary the size of a gas flow path through the annular inlet, the annular inlet being divided into at least two axially offset inlet portions, wherein the seal is constructed and arranged to allow for expansion and/or compression in a radial direction, whilst still maintaining seal functionality, and wherein the seal is constructed and arranged to, at least in use:

be in contact with a structure defining the inlet portions due to a resilience and/or shape of the seal; and/or allow for compression in a radial direction due to a gas flow pressure acting on the seal, wherein an inner diameter of the seal is greater than an outer diameter of the inlet portions, and wherein the seal is constructed and arranged to limit the compression to a diameter that substantially equates to, or exceeds, a diameter of the inlet portions, wherein the limit is provided in the form of a gap in a circumference of the seal that extends at least partially in the axial direction.

* * * * *